US005850646A

United States Patent [19]

Turner

[11] Patent Number: 5,850,646

[45] **Date of Patent: *Dec. 22, 1998**

[54] PRESSURE RELIEF MATTRESS

[76] Inventor: David R. Turner, 535 N. Corry Street, Fort Bragg, Calif. 95437

[ * ] Notice: The term of this patent shall not extend beyond the expiration date of Pat. No. 5,513,400.

[21] Appl. No.: 620,176

[22] Filed: Mar. 22, 1996

Related U.S. Application Data

[63] Continuation-in-part of Ser. No. 137,835, Oct. 15, 1993, Pat. No. 5,513,400.

[51] Int. Cl.[6] ..... A47C 27/08

[52] U.S. Cl. ..... 5/680; 5/683; 5/684; 5/665

[58] Field of Search ..... 5/665, 678, 680, 5/682, 683, 684, 686

[56] References Cited

U.S. PATENT DOCUMENTS

| | | | |
|---|---|---|---|
| 3,689,949 | 9/1972 | Weinstein et al. . | |
| 3,742,531 | 7/1973 | Alshury et al. | 5/680 |
| 3,840,921 | 10/1974 | Labianco . | |
| 4,055,867 | 11/1977 | Phillips . | |
| 4,057,862 | 11/1977 | Labianco . | |
| 4,187,566 | 2/1980 | Peterson . | |
| 4,317,244 | 3/1982 | Balfour-Richie . | |
| 4,346,489 | 8/1982 | McMullan . | |
| 4,663,790 | 5/1987 | Santo . | |
| 4,688,284 | 8/1987 | Write et al. | 5/682 X |
| 4,713,852 | 12/1987 | Fox, Sr. et al. . | |
| 4,793,013 | 12/1988 | Barbulla | 5/680 X |
| 5,062,170 | 11/1991 | Johenning . | |
| 5,086,528 | 2/1992 | Miller | 5/665 |
| 5,136,741 | 8/1992 | Balonick et al. . | |
| 5,513,400 | 5/1996 | Turner | 5/682 X |

FOREIGN PATENT DOCUMENTS 154445A 9/1985 United Kingdom .

*Primary Examiner*—Michael F. Trettel
*Attorney, Agent, or Firm*—Harris Zimmerman

[57] ABSTRACT

A pressure reduction mattress construction for a liquid or gel bed having a flexible basin forming a cavity with inclines head and foot for surrounding and supporting a liquid or gel filled flotation bladder that is anchored to the head of the basin. The inclines made of a soft yielding material allow the head or foot of the bed to be easily raised as the liquid or gel moves toward the center of the bed. The head incline also serves to provide a soft yielding surface to support a patient after liquid or gel has naturally moved to the sacral area. The entire structure is then covered with a flexible and yielding hospital fabric cover, giving the bed the appearance of a conventional hospital mattress. An optional heater pad may be used with a fiber filled sacral/pelvic bladder placed over the heater pad. Buoyant fiber material may be secured to portions of the inner surface of the upper sheet that forms the flotation bladder to provide additional lift to portions of a patient's body and thus reduce pressure on other, more vulnerable portions of the body.

7 Claims, 6 Drawing Sheets

PRESSURE RELIEF MATTRESS

REFERENCE TO RELATED APPLICATION

This application is a continuation-in-part of application Ser. No. 08/137,835, filed Oct. 15, 1993 by David Turner, now U.S. Pat. No. 5,513,400.

BACKGROUND

1. Field of the Invention

This invention relates generally to waterbeds, gel beds, and more particularly to flotation beds or hybrid waterbeds.

2. Discussion of Prior Art

Waterbeds have been in existence for a long period of time. They have been used extensively for therapeutic treatment of patients with, or at risk of, pressure ulcers. They have also been used for burn patients. More recently waterbeds with soft foam sides and covered with mattress ticking, often referred to as hybrid or flotation mattresses, have been introduced.

A number of specially designed and constructed bed bases, supports, overlays, waterbeds, or mattresses (hereinafter for convenience called flotation mattresses) have been proposed in attempts both to prevent the incidence of pressure ulcers and to promote the rapid healing of pressure ulcers. These flotation mattresses, when comprised of one or more liquid filled or gel filled bladders, have been unable to articulate for patients' comfort, therapeutic positioning, or sitting up in an adjustable hospital bed, and at the same time provide flotation where needed while in various postures. In some proposed flotation mattresses several bladders or tubes have been held in place by various means. The surfaces of the bladders pull taught and uncomfortable when lifted. There is also stress on the means of holding the water in place as well as on the lifting mechanism. The various chambers or tubes often have to be re-positioned after raising the head of the bed. Thinner flotation mattresses have been unable to be economically heated. Pressure reducing die-cut foam flotation mattresses break down in the critical areas subject to pressure ulcers, and thereby lose their therapeutic value. Air loss systems are expensive, noisy and require adjustment and monitoring.

All of the flotation mattresses designed for use on hospital beds to relieve pressure heretofore known suffer from a number of disadvantages:

a) Flotation mattresses that offer adequate pressure relief to all parts of the body are too heavy to place on standard hospital bed bases.
b) Raising the head of flotation mattresses in present use places unnecessary strain on the lifting mechanism.
c) If one raises the head of flotation mattresses in present use the support for the back is lost and the occupant is left without a comfortable backrest.
d) If one raises the head of flotation mattresses in present use the flotation bladder or bladders move out of position.
e) If one raises the head of flotation mattresses in present use the weight of the occupant is shifted to the sacral area which is not provided with additional support.
f) The use of fluid or gel compartments which are held in place result in a taught, uncomfortable support surface and stress on the means of holding the liquid or gel in a vertical position.
g) Flotation mattresses with a butt seam construction have not been fitted with a baffle system that is securely tethered.
h) Flotation mattresses in use on hospital beds are unable to be easily and economically heated. They are shallow and the occupant can bottom out, resulting in direct contact with the heater pad.
i) Flotation mattresses in use have an exposed zipper which allows liquid and other contaminants to enter the flotation mattress and are difficult to clean.
j) A leak in flotation mattresses in use can spill over the foot of the mattress when the head is raised.
k) Die-cut foam pressure relief mattresses break down quickly.

There is still a need for an inexpensive durable flotation bed which provides a person relief from pressure in various postures. There is also a need to be able to heat such an articulating flotation bed.

OBJECTS OF THE INVENTION

The objects and advantages of the present invention are:

a) to use as little liquid as possible and still provide relief from pressure on the skin of the resting patient;
b) to provide means for displacing liquid or gel as the head of the mattress so as to put little additional strain on the lifting mechanism of an articulated hospital bed;
c) to provide a means of bringing a stable backrest into position as the head of the mattress is raised into a sitting position;
d) to provide a means to hold a liquid filled bladder or bladders in place as the head of the bed is raised without stress on the bladder or means of securing the bladder;
e) to provide a self-supporting, flexible frame with a fluid or gel filled container or bladder that will provide relief from pressure while lying flat and also support a body when the head and/or foot is raised and continue to provide relief from pressure to all areas of the body;
f) to provide a comfortable pressure relieving flotation mattress that does not need to hold water or gel in place as the head of the mattress is raised;
g) to provide means of tethering a baffle or motion reducing mechanism in a fluid filled flotation mattress constructed with butt seams;
h) to provide a method of economically and simply heating an articulating flotation mattress;
i) to provide a cover that will protect the zipper and inside of the flotation mattress from fluid and be easy to clean;
j) to provide a containment system so that liquid will not escape over the foot of the flotation mattress in case of a leak while the flotation mattress head is in the raised position;
k) to provide a durable pressure relief mattress.

Further objects and advantages of the present invention are to provide a pressure relief flotation mattress that is inexpensive to manufacture and easy to use. Still further objects and advantages will become apparent from a consideration of the drawings and ensuing description.

SUMMARY OF THE INVENTION

The present invention relates to hybrid waterbed or gel mattresses. A bladder containing liquid is restrained laterally by two flexible soft sides and two inclines of flexible soft material at the head and foot; all attached to and supported by a flexible soft base. In the present embodiment, various densities of flexible polyurethane foam are used for the sides, inclines and base.

The flotation mattress construction is disclosed having a soft flexible base and frame assembly which when placed on a hospital bed base or other foundation is entirely self supporting and will retain its pressure reduction qualities over prolonged used.

The base in its present embodiment is high-quality foam, 1" by 36" by 76".

The sides in their present embodiment are two truncated foam wedges that are approximately 5" high, 2" wide at the top, and 5" wide at the bottom. The outside wall is a vertical plane, while the inside wall is sloped inward. The bottom of the sides rest on the foam base. This shape provides for a smaller surface of the sides being exposed to the resting area of the flotation mattress. It also provides greater structural integrity to contain the fluid or gel filled bladder.

The head and foot inclines in their present embodiment are two identical foam wedges that are 5" high and slope toward the center of the bed approximately 28". Two additional oblique wedges of foam are attached to the head incline to form a cavity for the bladder smaller at the head, much like the shape of the human body.

The bladder it its present embodiment comprises three sheets of flexible film butt welded together to form a container for liquid with an internal membrane. The two outer membranes are cut so that when welded together they form an envelope or bladder that will loosely encompass the cavity formed by the basin. The middle membrane is cut to substantially the mid-height dimension of the cavity and perforated with one or several large voids. Attached to the middle membrane is a woven fiber material that dampens the wave action of the liquid. The head edge of the bladder is trimmed with an extra flange protruding enough in which to place grommets. These grommets are then used to anchor or tether the head portion of the bladder to the incline and base.

Upon raising the head of the flotation mattress, the liquid or gel is displaced to the middle of the bed, providing extra support under the sacral area of the occupant. The bladder remains in place, with no strain on the bladder, flange nor anchor.

The head incline automatically displaces the water so that the lifting mechanism must lift virtually no additional weight.

As the head is raised, the head incline automatically replaces the fluid or gel as a back support, making sitting up in bed as easy as on a standard hospital mattress, yet still relieving pressure in the sacral area.

The base, side rails and inclines are then covered by a form fitted vinyl liner to protect the foam and capture any liquid that might escape. A secondary boot liner is placed over the foot end of the liner to prevent any leakage outside of the primary liner when the head is raised and the level of liquid at the foot of the mattress is above the primary liner. Comprised of two sheets of vinyl sealed on three sides, the boot liner slides over the foot of the bladder.

A smaller sacral bladder is manufactured with a fiber batt sealed inside. It is filled with fiber and liquid and placed in the center of the bed, between the head and foot inclines. This bladder prevents the patient from displacing all water beneath the sacral area providing another level of flotation. This sacral bladder also enables the use of a heating pad which is placed directly under it. The fiber in the sacral area will prevent liquid from being totally displaced, thus avoiding the danger of creating a hot spot.

The entire assembly is then encased in a cover made of a hospital fabric that is flexible and conforming. In the present embodiment this cover has a zipper which goes 360° around the bottom of the cover. The hem above the zipper is made wider than usual, so that it covers the entire zipper. Fluids that might drip down the side of the fluid proof cover will drip past the zipper.

REFERENCE NUMERALS IN THE DRAWINGS

| | |
|---|---|
| 10 | basin |
| 12 | base |
| 14 | side rails right (r) and left (l) |
| 16 | inclines head (H) and foot (F) |
| 18 | oblique wedges right (r) and left (l) |
| 20 | cavity |
| 21 | sacral area |
| 22 | heater pad |
| 24 | liner |
| 25 | fiber |
| 26 | sacral bladder |
| 28 | sacral bladder valve |
| 29T | top film/membrane |
| 29B | top film/membrane |
| 30 | flotation bladder |
| 31A | middle film/membrane |
| 31B | fiber |
| 32 | bladder valve |
| 33 | grommets |
| 34 | flange |
| 35 | ties |
| 36 | anchor assembly |
| 37 | anchor |
| 38 | boot liner |
| 40 | cover |
| 41 | zipper |
| 42 | zipper hem |
| 44 | zipper pulls |
| 48 | liquid or gel |
| 50 | air frame |
| 52 | air chamber |
| 54 | liquid chamber |
| 56 | inclined plane - head (H) and foot (F) |
| 58 | air frame incline chamber- head (H) and foot (F) |
| 60 | air frame valves |
| 62 | fill |
| 64 | extended flange/sleeve |
| 66 | butt weld |
| 68 | anchor material |
| 70 | die cut |
| 100 | basin |
| 101 | top sheet |
| 102 | medial sheet |
| 103 | bottom sheet |
| 104 | upper chamber |
| 106 | lower chamber |
| 107 | flow hole |
| 108 | fiber batts |
| 109 | fiber batts |

-continued

| | |
|---|---|
| 116 | afferent incline |
| 122 | heater pad |
| 125 | fiber batts |
| 126 | sacral/pelvic bladder |
| 130 | bladder |

DESCRIPTION OF THE PREFERRED EMBODIMENT

Until now, neither waterbeds nor flotation or hybrid mattresses containing water or gel have been able to both provide adequate pressure relief and articulate to a comfortable sitting up position.

Figure 1:
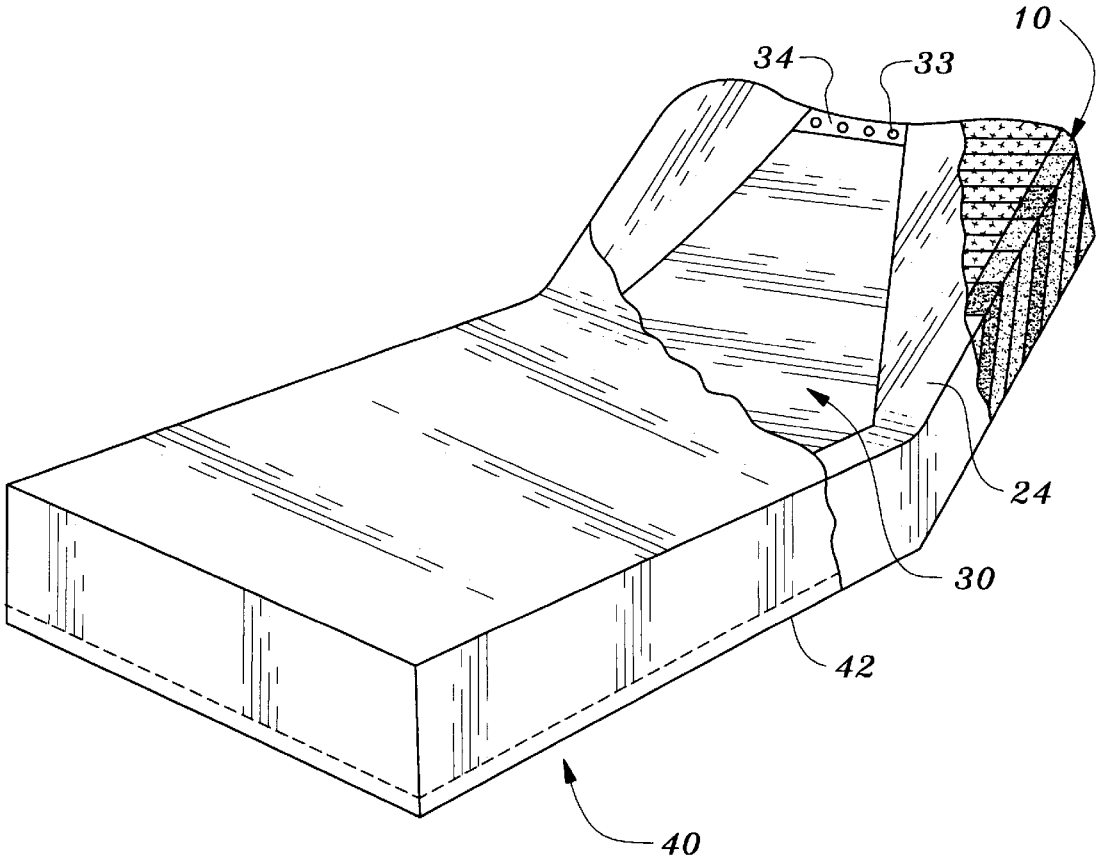
FIG. 1 is a perspective view, partially cut away, of the partially articulated pressure relief mattress of the present invention.

Referring now to FIG. 1 there is shown the partially cut away pressure relief mattress of the present invention in an articulated position. Pressure relief mattress is designed with a cover 40 of hospital fabric which is fluid proof, bacteria resistant, fire resistant, supple and conforming. Cover 40 opens by way of a zipper 41 (shown in FIG. 3) which is covered by a zipper hem 42 all around the bottom edge of the pressure relief mattress to allow for full opening of pressure relief mattress and access to the various components which will be described more fully hereinafter. A primary flotation bladder 30 rests in a vinyl liner 24 and a basin 10. The head end of flotation bladder 30 has a flange 34 with grommets 33 for tethering to head portion of flotation mattress.

Figure 2:
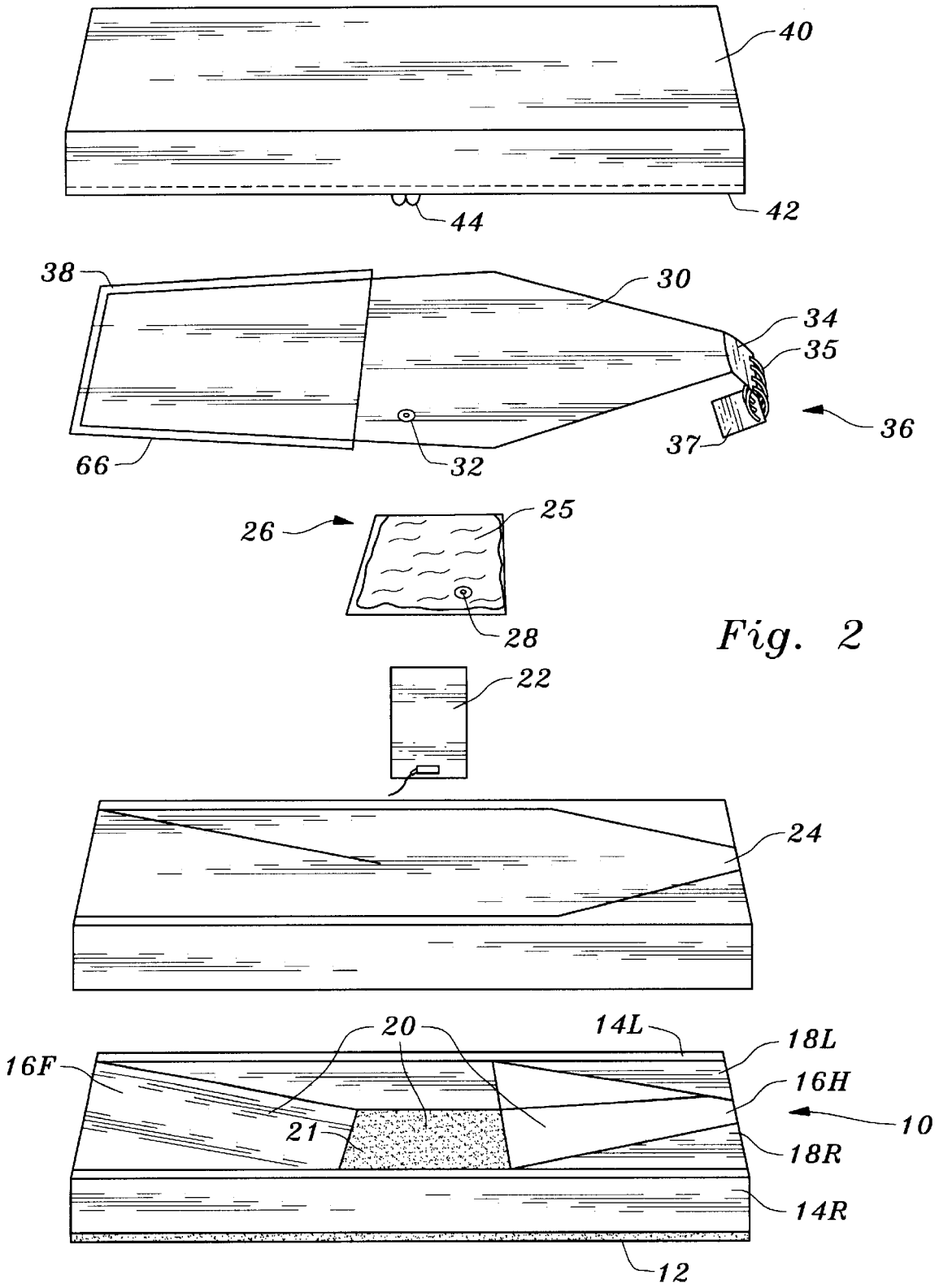
FIG. 2 is an exploded view of the pressure relief mattress of the invention, showing the various components.
Figure 3:
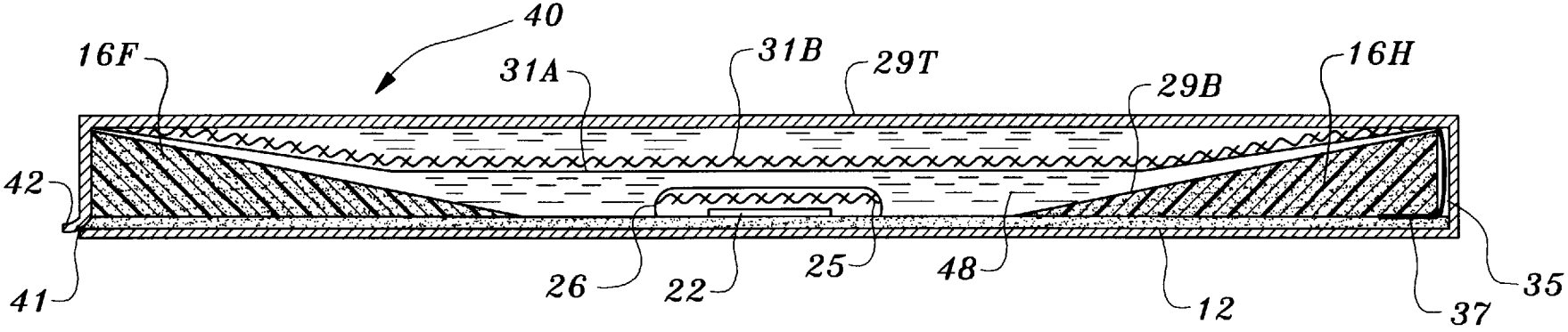
FIG. 3 is a cross-sectional elevational view of the pressure relief mattress of the invention.

The pressure relief mattress of the present invention has a number of separate and distinct components illustrated in FIGS. 2 and 3. In these figures there is shown basin 10 which in this embodiment in made up of seven pieces of foam in different densities glued together: a foam base 12, a pair of side rails 14R, 14L (right and left), a head incline 16H, a foot incline 16F, and an oblique wedge or wedges 18R, 18L (right and left). Important features of this invention are the head incline 16H and foot incline 16F. Liner 24 covers the inside, upper, and outer surfaces of basin 10, wrapping approximately two inches under base 12.

A heater pad 22 may be placed on top of liner 24 in a sacral area 21 between head incline 16H and foot incline 16F.

A sacral bladder 26 is placed over sacral area 21 which will place it directly above heater pad 22 and liner 24. Sacral bladder 26 is an important part of this invention. Sacral bladder 26 consists of two sheets of vinyl (flexible polyvinyl chloride film) lap welded together around a piece of fiber 25 to form a container for liquid. A sacral bladder valve 28 is provided to fill bladder 26 with liquid.

Figure 4:
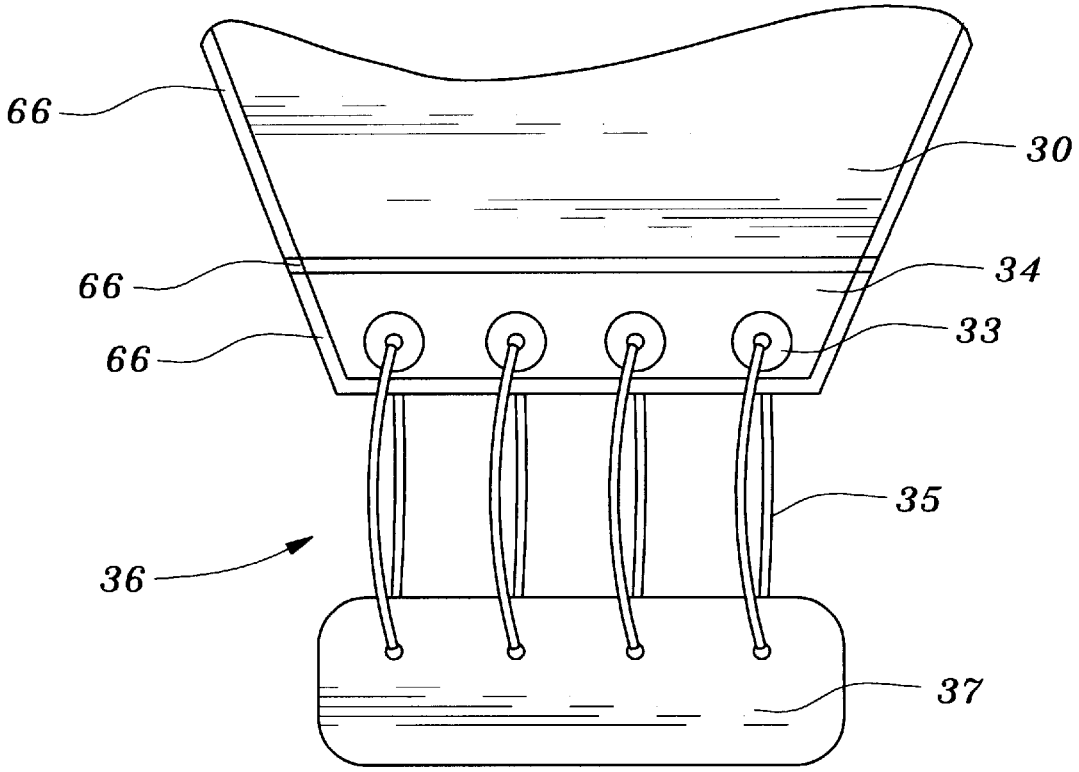
FIG. 4 is an illustration of the flotation bladder anchor assembly.

Flotation bladder 30 consists of three sheets of vinyl (flexible polyvinyl chloride film) joined together with a butt weld 66 to form a container for liquid with an internal membrane. The top and bottom membranes 29T and 29B are cut so that when welded together they form an envelope or bladder that will loosely encompass the cavity formed by the basin 10. The middle membrane 31A is a fiber 31B material that dampens the wave action of the fluid. This middle membrane 31A is an important part of this invention. The head edge of flotation bladder 30 is trimmed with an extra flange 34 protruding enough in which to place a grommet or grommets 33. As is illustrated in FIG. 4, flange 34 and grommets 33 are then used to anchor or tether the head portion of the flotation bladder 30 to basin 10 by means of a tie or ties 35 and anchor 37. Anchor 37 is placed between the bottom of basin 10 and cover 40. In the preferred embodiment, the anchor 37 and ties 35 are made of Plexiglas™ or similar acrylic plastic material and polyethylene tubing respectively. Flange 34, ties 35, and anchor 37 are important parts of this invention. The vinyl film of the flotation bladder 30 is designed to allow liquid 48 to fill the remainder of cavity 20 formed by basin 10 yet lay loose on top to provide maximum bodily displacement. A bladder valve 32 is provided to fill bladder 30 with liquid 48.

A boot liner 38 is made of two sheets of vinyl (flexible polyvinyl chloride film) joined together with a butt weld 66 to form a boot or cap. Boot liner 38 slips over the foot end of bladder 30. Boot liner 38 is an important part of this invention.

Figure 5:
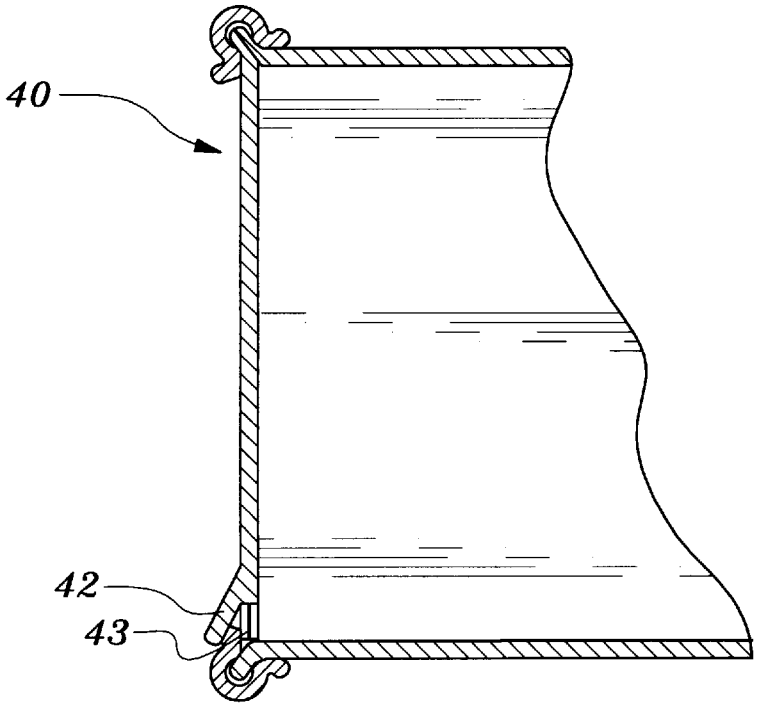
FIG. 5 is a partial side view of the cover, zipper, and zipper hem.

Cover 40 encompasses all of basin 10 and various components. It consists of a fluid proof, bacteria resistant, fire resistant, supple and conforming hospital fabric. As is shown in FIG. 5, said cover 40 includes zipper 41 at the bottom edge that goes 360° around the pressure relief mattress. Extra wide zipper hem 42 is sewn over the entire top edge of zipper 41. Zipper hem 42 is an important part of this invention.

THEORY OF OPERATION

The manner of using my pressure relief mattress of the present invention requires no greater effort on the part of the patient or nursing staff than does a regular hospital mattress with the exception of having the ability to control the temperature of the sleeping environment. In fact, my pressure relief mattress requires less nursing attendance due to its pressure relief characteristics.

When a patient lies on my pressure relief mattress, the fluid is automatically displaced and pressure on the skin is spread over more of the body. The resulting pressure over the body is less than that which would cut off blood circulation and cause pressure sores. Important parts of this invention are foot incline 16F and head incline 16H and the manner in which they displace the liquid or gel 48 to sacral area 21 when the head or foot of the hospital bed is raised. As the head of the bed is lifted, there is virtually no added weight for the mechanism to lift because of incline 16H having zero liquid or gel 48 at the outer edge. At the same time head incline 16H is displacing liquid 48 it begins to offer the patient comfortable support as a back rest. The displaced fluid has now naturally moved to sacral area 21 where the patient, when sitting up, needs additional sacral pressure relief. In addition, liquid 48 in flotation bladder 30 swells beneath the knees, causing the patient to assume a healthy posture of knees up and apart.

Anchor assembly 36 holds flotation bladder 30 in place as the head of the bed is raised. Fiber 31B slows down the motion of the fluid. Middle membrane 31A keeps the fiber 31B from shifting out of position.

Sacral bladder 26 prevents the patient from ever bottoming out on heater pad 22 (which could cause overheating) or foam base 12 which could cause pressure ulcers. This protection from bottoming out provided by sacral bladder 26 allows flotation bladder 30 to be under-filled for maximum bodily displacement without fear of touching heater pad 22 or foam base 12.

Boot liner 38 serves to keep any leakage from the foot end of flotation bladder 30 from escaping outside the system while the head of pressure relief mattress is raised and the fluid is displaced to area 21 and foot of flotation bladder 30.

An incontinent patient, liquid spills, wound seepage, etc., will not cause harm to my pressure relief mattress. The cover is made of a fluid-proof bacteria resistant hospital fabric. An extra wide zipper hem 42 at the top of the zipper 43 shields the zipper 6 from escaped bodily fluids or other liquids that might drip down the outside of the cover 40. The fluids will pass over the hem 42 and past the zipper 43.

Figure 9:
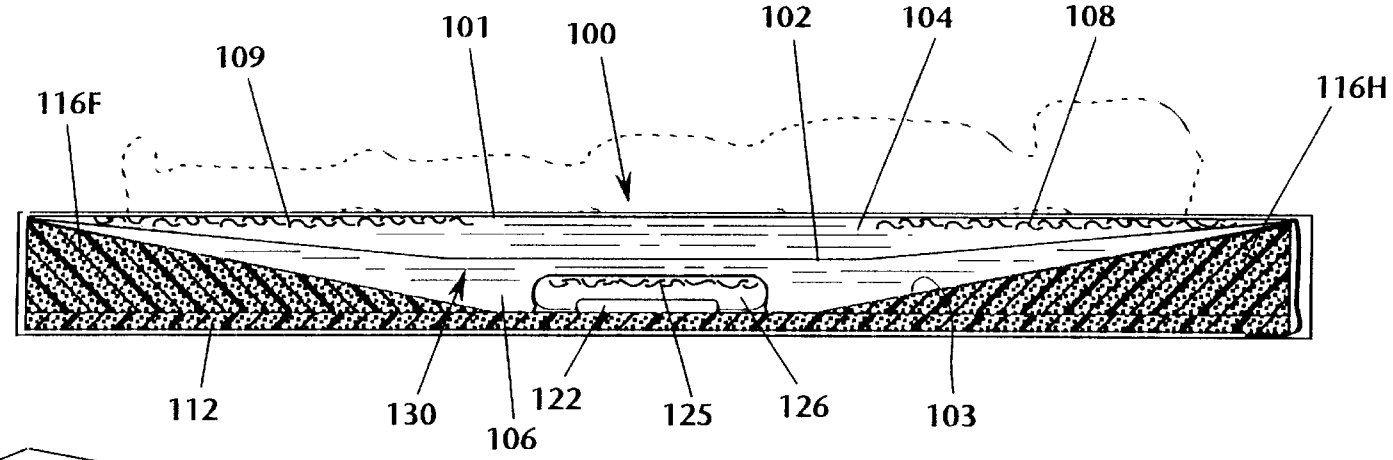
FIG. 9 is a cross-sectional side elevation of a further embodiment of the pressure relief mattress assembly, shown in a horizontal disposition.
Figure 11:
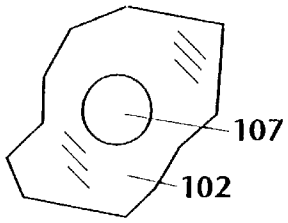
FIG. 11 is a detail view of a portion of the flotation bladder of the invention.
Figure 10:
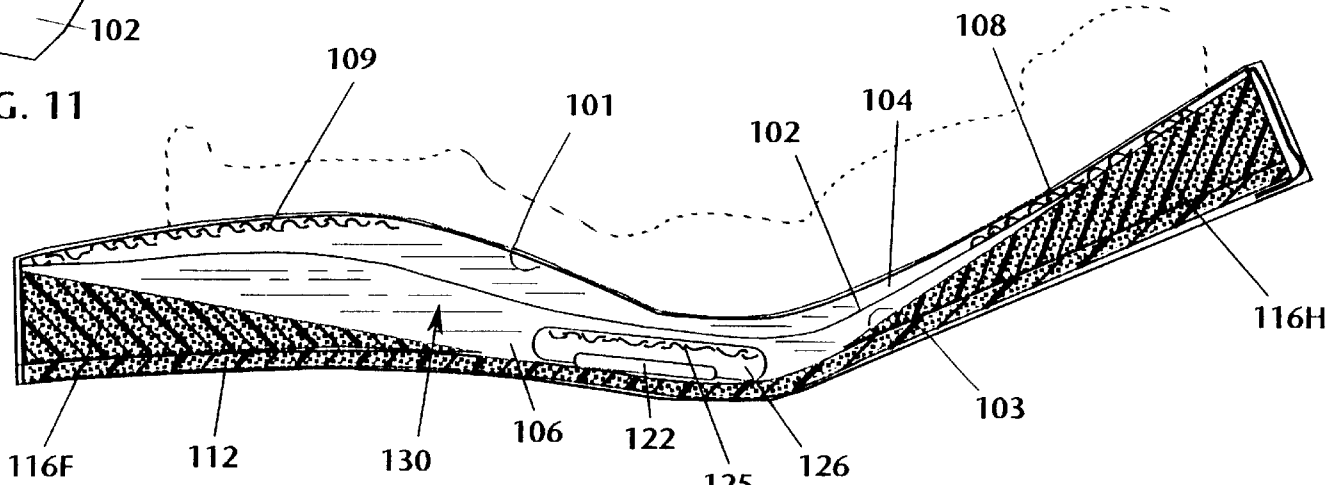
FIG. 10 is a cross-sectional elevation of the embodiment of FIG. 9, shown in an articulated disposition.

A further embodiment of the pressure relief mattress assembly, shown in FIGS. 9 and 10, includes a flexible base panel 112, a head incline 116H, and a foot incline 116F. The assembly also includes side rails and oblique wedges, as shown in the previous embodiment, that, together with the head and foot inclines, define a basin 100 for supporting and containing a liquid bladder assembly. A liner covers the inside, upper, and outer surfaces of the basin 100 to contain any liquid spills from the bladder assembly. A sacral/pelvic bladder 126 is disposed on the liner at a medial position of the basin 100 and directly atop a heater pad 122. The sacral bladder is constructed as described in the previous embodiment, and is likewise provided with internal fiber batting 125.

Disposed within the basin 100 and within the liner is a flotation bladder 130 that is dimensioned to be received within the basin 100. In particular, the bladder 130 includes a tapered head end that is dimensioned to be received between the oblique wedges 18, as shown in FIG. 2. The bladder 130 is comprised of three sheets 101, 102, and 103 of vinyl film or the like having the same peripheral configuration and joined together with a continuous weld at the confronting edges to define upper and lower chambers 104 and 106. One or more holes 107 is formed in the medial sheet 102 to permit fluid flow between the two chambers. The bladder 130 is provided with an anchor at the head end to secure the bladder to the assembly, as described in the previous embodiment.

A salient feature of this embodiment is the provision of fiber batts 108 and 109 secured to the inner surface of the top sheet 101 of the bladder. These batts are formed of fiber that is buoyant in the liquid that fills the bladder, thereby exerting an upward lift on the sheet 101 that augments the upward thrust of liquid pressure within the bladder. The batts 108 and 109 are disposed at the head and foot portions respectively of the bladder 130, whereby enhanced support is provided to the head-thorax region and legs of a patient. The medial portion of the patient's body is supported only by the liquid displacement buoyancy of the bladder. Thus more of the body weight is supported at portions of the body that are less likely to develop pressure sores, and patient comfort is increased.

Other features disclosed with respect to the previous embodiment may also be provided, such as the boot liner, head anchor, zipper construction, hospital cover, and the like.

It may be appreciated that the mattress assembly is well-adapted for use with articulated hospital beds. As shown in FIG. 10, the assembly may be articulated by raising the head end, without loss of flotation support of the major portion of the patient's weight. The provision of the afferent incline 116H minimizes the liquid mass to be raised by the articulating bed mechanism, and assures that the liquid will quickly drain from the head end as it is raised. Furthermore, the foam incline 116H becomes an upwardly slanted back rest as the liquid drains from the head end, and the fiber batts 108 provide a soft, cushioned surface for the patient to recline against.

Liquid displaced from the head end inflates the medial and foot portions of the bladder. The body weight is concentrated in the medial portion, thus displacing some liquid to the foot end. As a result the knees become raised, as shown in FIG. 10, promoting a posture that is known to be beneficial for a bedridden patient. At the same time, the sacral/pelvic bladder 126 prevents bottom contact by the posterior of the patient, and the fiber batt within the bladder 126 insulates and isolates contact with the heater pad 122.

CONCLUSIONS, RAMIFICATIONS, AND SCOPE OF THE INVENTION

Thus the reader will see that the pressure relief mattress of the present invention provides a patient with the benefits of flotation support while being able to be articulated into a sitting position. Furthermore, the pressure relief mattress has the additional advantage in that:

- it allows the economical heating of the pressure relief mattress;
- it provides flotation with a minimum of liquid or gel, resulting in a lighter flotation mattress;
- it provides a means for keeping the flotation bladder in place while the head of the bed is raised;
- it provides a means for capturing any leakage at the foot of the bed when the water level is above the top level of the basin;
- it provides a means of preventing fluid from leaking into the flotation mattress through the zipper; and, it allows for the tethering of baffles in a butt seamed flotation bladder.

Figure 8:
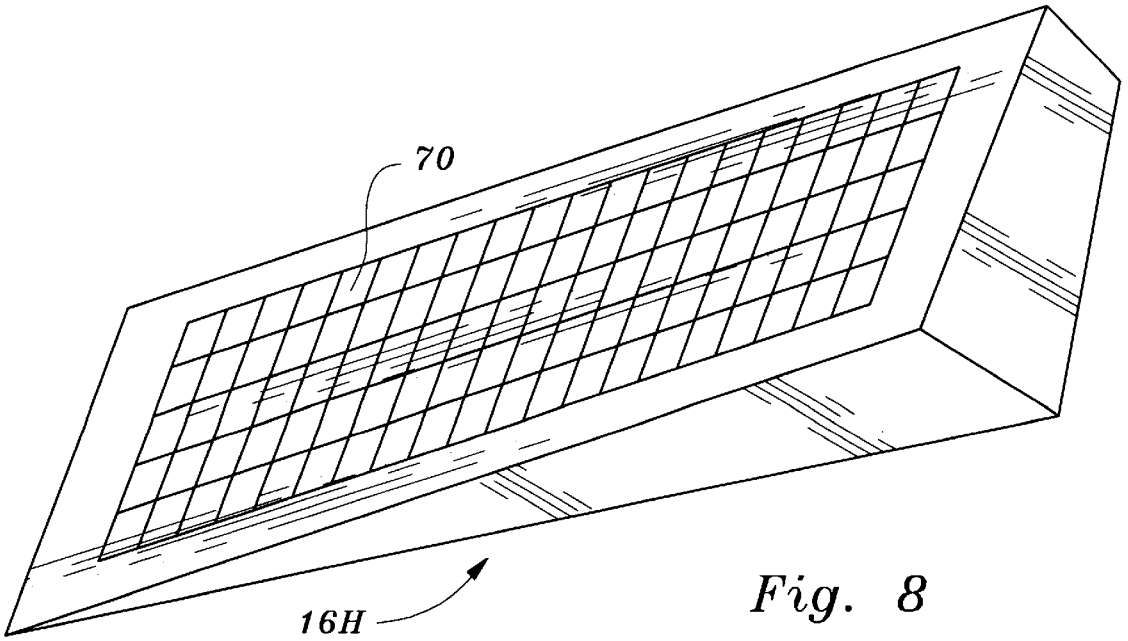
FIG. 8 is a perspective view of a die cut embodiment of the head incline.

While my above description contains many specificities, these should not be construed as limitations on the scope of the present invention, but rather as an exemplification of one preferred embodiment thereof. Many other variations are possible. For example:

The basin 10 could be made with different shaped and sized base 12, side rails 14R and 14L, and/or oblique wedges 12R and 12L;

Or the inclines 16H and 16F discussed above could also be of different dimensions, ranging anywhere between 20 inches to 50 inches in length; inclines 16H and 16F could be varied for different body types to even further regulate the volume of water to body weight; in addition, inclines 16H and 16F could be made of another material such as air chambers, convoluted or die-cut foam 70 (as shown in FIG. 8), foam rubber, etc.

Figure 6:
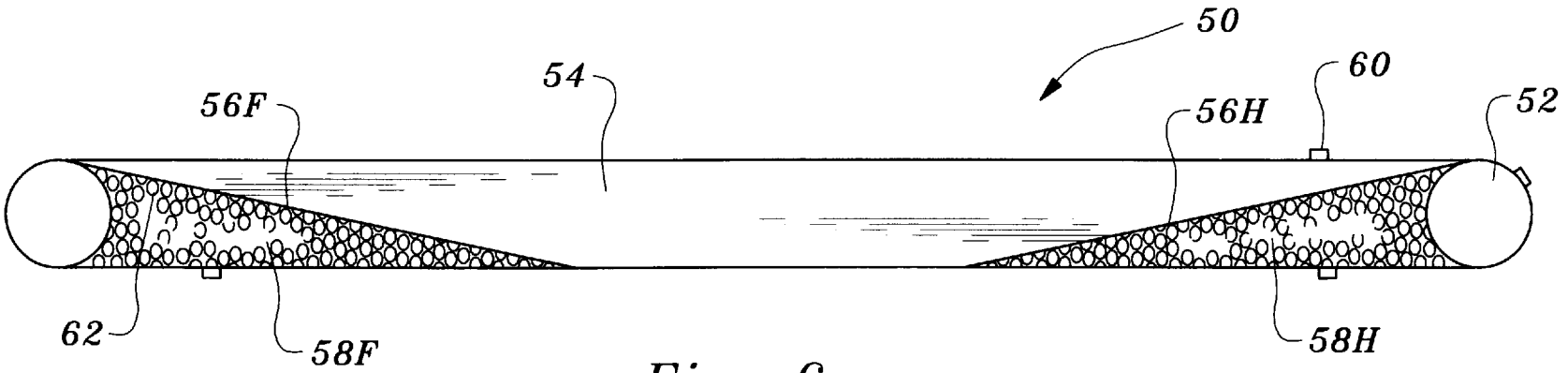
FIG. 6 is a cross sectional elevational view of an air frame embodiment of the present invention.

As illustrated in FIG. 6, the entire basin 10 could be made or rectangular chambered flexible film and filled with air and a liquid chamber 54 created by covering the basin with a sheet of flexible film, sealed at the air chamber 52. This construction is revealed in the prior art and commonly referred to as an air frame waterbed 50. Two afferent inclines 56H and 56F of flexible film could be welded into place, creating an air frame head incline 58H and an air frame foot incline 58F and filled with a fill substance 62 such as air, Styrofoam pellets, foam, etc.

In another embodiment, the flotation bladder 30 would be made without a middle membrane 31A and without fiber to slow down the liquid 48. The flotation bladder 30 could also be made of another flexible material.

Figure 7:
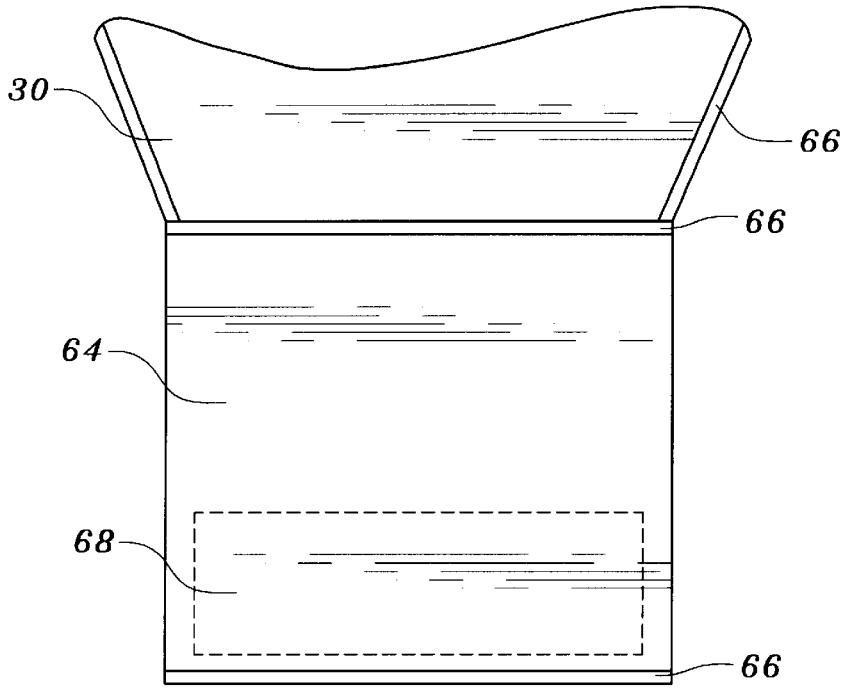
FIG. 7 is an illustration of the extended flange/sleeve embodiment of the flotation bladder anchor assembly.

As is shown in FIG. 7, flange 64 of mattress 30 could be extended to wrap around basin 10 itself. A pocket or sleeve 64 could be seamed in the end of the extended flange in which a substance 68 such as foam, cardboard, closed cell foam, etc., could be inserted which would keep the flotation bladder 30 in place.

In yet another embodiment, flotation bladder 30 could be sealed with lap seams. The corners at the top of the flotation bladder 30 could be tethered in one of the many methods developed for tethering internal baffles, such as discussed by Johennings in U.S. Pat. No. 5,062,170. Any method heretofore invented for the tethering of an internal baffle in a waterbed could be used to tether the head of the flotation bladder 30 to the basin 10.

Accordingly, the scope of the invention should be determined not by the embodiment illustrated, but by the appended claims and their legal equivalents.

I claim:

1. A hybrid liquid mattress with a soft, flexible basin adapted for use with an articulated frame, the improvement comprising:

a articulatable, flexible base member supporting a basin;

a cavity formed by said basin;

a flotation bladder filled with liquid and formed to fit into said cavity;

an afferent head incline disposed at a head end of said mattress and defining a portion of said cavity;

said mattress being movable from a generally horizontal first position in which said afferent head incline supports a head end of said flotation bladder, to a second position in which said head end of said mattress is tilted to slope upwardly and said liquid drains from said head end of said flotation bladder and said afferent head incline becomes a back rest for a patient supported on said mattress, said flotation bladder including a top sheet for containing said liquids and further including buoyant material means secured to the inner surface of said top sheet at predetermined locations to provide augmented lift and support to selected portions of a body on said mattress.

2. The hybrid liquid mattress of claim 1, wherein said buoyant material means is disposed at said head end of said flotation bladder.

3. The hybrid liquid mattress of claim 2, wherein said buoyant material means is disposed to overlay said afferent head incline.

4. The hybrid liquid mattress of claim 2, wherein said buoyant material means is also disposed at the foot end of said flotation bladder.

5. A hybrid mattress construction with a soft, flexible basin adapted for use with an adjustable frame, the improvement comprising:

a cavity formed by said basin;

a flotation bladder formed to fit into said cavity;

means for displacing liquid in said bladder and serving as a backrest as the head of the frame is raised, including an afferent head incline;

wherein said flotation bladder comprises top, middle, and bottom sheets of flexible film welded together to form said bladder with a middle membrane therebetween, said top and bottom sheets of said flexible film dimensioned so that when welded together said top sheet and bottom sheet form said bladder, said middle membrane extending to the mid-height dimension of said cavity and perforated with at least one opening; and, buoyant material means secured to the inner surface of said top sheet at predetermined locations to provide augmented lift and support to selected portions of a body on said mattress.

6. A hybrid liquid mattress with a soft, flexible basin adapted for use with an articulated frame, the improvement comprising:

a articulatable, flexible base member supporting a basin;

a cavity formed by said basin;

a flotation bladder filled with liquid and formed to fit into said cavity;

a smaller flotation bladder disposed beneath a medial portion of said flotation bladder;

said mattress being movable from a generally horizontal first position to a second position in which said head end of said mattress is tilted to slope upwardly and said liquid drains from said head end of said flotation bladder and said smaller flotation bladder prevents bottom contact by the posterior of a patient on said mattress.

7. A hybrid liquid mattress with a soft, flexible basin adapted for use with an articulated frame, the improvement comprising:

a articulatable, flexible base member supporting a basin;

a cavity formed by said basin;

a flotation bladder filled with liquid and formed to fit into said cavity;

an afferent head incline disposed at a head portion of said mattress and defining a head portion of said cavity, said afferent head incline including a generally planar upper surface inclined upwardly and outwardly toward a head end of said mattress;

said flexible base member being deformable from a generally horizontal first position in which a head portion of said base member extends generally horizontally, to a second position in which said head portion of said base member is tilted to slope upwardly;

said planar upper surface of said afferent head incline supporting a head portion of said flotation bladder when said flexible base member is in said first position, and sloping upwardly at an increased angle when said flexible base member is in said second position, said planar upper surface at said increased angle disposed to displace liquid from said head portion of said flotation bladder and directly support the head and upper back of a patient supported on said mattress.

* * * * *